US010500700B1

(12) United States Patent
Goldman

(10) Patent No.: US 10,500,700 B1
(45) Date of Patent: Dec. 10, 2019

(54) EFFICIENCY OF CONSTRUCTION VIA AN ON-SITE PORTABLE SELF-SUPPORTING STRUCTURAL ASSEMBLY JIG

(71) Applicant: Gary B. Goldman, North Miami Beach, FL (US)

(72) Inventor: Gary B. Goldman, North Miami Beach, FL (US)

( * ) Notice: Subject to any disclaimer, the term of this patent is extended or adjusted under 35 U.S.C. 154(b) by 24 days.

(21) Appl. No.: 15/587,541

(22) Filed: May 5, 2017

(51) Int. Cl.

| | |
|---|---|
| ***B25B 11/02*** | (2006.01) |
| ***E04G 21/18*** | (2006.01) |
| ***E04B 2/56*** | (2006.01) |
| ***E04F 21/00*** | (2006.01) |
| ***E04G 21/26*** | (2006.01) |

(52) U.S. Cl.
CPC ..... *B25B 11/02* (2013.01); *E04B 2/56* (2013.01); *E04F 21/0015* (2013.01); *E04G 21/18* (2013.01); *E04G 21/1841* (2013.01); *E04G 21/1891* (2013.01); *E04G 21/26* (2013.01)

(58) Field of Classification Search
CPC .. E04F 21/1855; E04F 21/0015; E04G 21/18; E04G 21/1841; E04G 21/1891; E04G 21/26; B25B 11/02; E04B 2/56
See application file for complete search history.

(56) References Cited

U.S. PATENT DOCUMENTS 2,305,124 A * 12/1942 Wilson, Jr. ..... B25B 11/02 227/152
2,567,586 A * 9/1951 Werder ..... E04G 21/1891 269/40
2,935,103 A * 5/1960 Landis, Jr. ..... E04G 21/1891 269/40
3,539,174 A * 11/1970 Borello ..... E04G 21/1891 269/319
4,527,337 A * 7/1985 Dreiling ..... G01B 5/02 30/358
4,596,101 A * 6/1986 Brinker ..... E04B 1/2604 52/317
4,625,415 A * 12/1986 Diannontis ..... E04G 21/1891 33/562
4,629,171 A * 12/1986 Judy ..... B25B 11/02 269/207
5,031,886 A * 7/1991 Sosebee ..... B25B 5/142 269/41

(Continued)

*Primary Examiner* — Jessie T Fonseca
(74) *Attorney, Agent, or Firm* — Malloy & Malloy, P.L.

(57) ABSTRACT

A portable self-supporting vertical wall assembly jig residing at a construction site can include two parallel vertical supports, two perpendicular horizontal supports, and a removable wall platform. The vertical supports can each have one hinge which reduces the height by at least one third. The two perpendicular horizontal supports can include a top horizontal support and a bottom horizontal support. The removable wall platform can be able to be removed after construction of a vertically assembled wall. When the platform is removed from the jig, the platform completely can support the wall and can be able to transport the wall to location different from the assembly jig without additional construction equipment. The wall can include a top plate, a bottom plate, and two vertical elements. The top and bottom horizontal support can include spacers which temporarily brace the two vertical elements of the wall during vertical assembly of the wall.

2 Claims, 16 Drawing Sheets

(56) References Cited

U.S. PATENT DOCUMENTS

| | | | | | |
|---|---|---|---|---|---|
| 5,129,153 | A * | 7/1992 | Burns, Sr. | E04G 21/1891 | 33/501.45 |
| 5,414,918 | A * | 5/1995 | Pearson | B23D 47/025 | 227/152 |
| 5,542,653 | A * | 8/1996 | Maloney | B23Q 1/03 | 269/303 |
| 5,566,931 | A * | 10/1996 | Considine | B27M 3/0073 | 269/111 |
| 5,628,119 | A * | 5/1997 | Bingham | E04G 21/1891 | 269/904 |
| 8,448,348 | B1 * | 5/2013 | Jones | E04G 21/1891 | 33/613 |
| 2002/0023402 | A1 * | 2/2002 | Winchester | E04B 5/12 | 52/474 |
| 2008/0313916 | A1 * | 12/2008 | Xedis, IV | E04G 21/1891 | 33/613 |
| 2010/0199595 | A1 * | 8/2010 | Morris | E04G 21/1891 | 52/745.05 |
| 2013/0186037 | A1 * | 7/2013 | Hokanson | E04F 21/0015 | 52/745.15 |
| 2013/0219732 | A1 * | 8/2013 | Jordan | E04G 21/1891 | 33/613 |
| 2017/0138719 | A1 * | 5/2017 | Woodruff | E04G 21/1891 | |
| 2017/0328074 | A1 * | 11/2017 | Ayvazian | E04G 21/1891 | |

* cited by examiner

100A

Embodiment 110

Embodiment 130

Embodiment 150

Embodiment 160

100D

Embodiment 170

100E

200A

Embodiment 210

Embodiment 220

300

500A

Embodiment 510

500B

Embodiment 530

500C

Embodiment 550

EFFICIENCY OF CONSTRUCTION VIA AN ON-SITE PORTABLE SELF-SUPPORTING STRUCTURAL ASSEMBLY JIG

The present invention relates to the field of wall assembly jigs and, more particularly, to improving the efficiency of construction via an on-site portable self-supporting structural assembly jig.

Traditionally, construction practices rely on building materials which are delivered to a construction site. These practices include the delivery of raw materials (e.g., such as lumber, fasteners), construction equipment (e.g., cranes, forklifts) and even prefabricated elements (e.g., walls, concrete slabs). For example, flatbed trucks are often employed to deliver roofing segments or wall segments to speed up construction of a large building. Many times, prefabricated elements are assembled offsite and transported, often large distances, to the construction site. Many times elements can be large and substantially hollow which can be expensive to transport and highly inefficient (e.g., due to size). For example, a framed wall with studs can be primarily hollow due to empty space between studs and as a result require a large amount of space to transport the wall although the unassembled materials take up a substantially smaller amount of space to transport.

Further, construction of structural assemblies is traditionally performed on a horizontal plane which requires laborers to continually bend over to affix support elements during construction. Since laborers are required to continually bend over, laborer fatigue is quick to occur and can result in slowed construction times and injured workers (e.g., back injuries). Further, large structural assemblies are often dangerous for laborers to work with due to heavy equipment required to assist in the construction. For example, conventionally outer and inner walls are constructed on site after which roof beams are constructed and manipulated in place. The roof work, which includes handling horizontal subfacia, then vertical subfacia, then installing bucks, cutting overhangs for buckets, and constructing the outlooker is all done up in the air. Construction workers are standing on ladders in precarious positions handling heavy objects and making manual adjustments.

BRIEF SUMMARY

One aspect of the present invention can include a system for improving the efficiency of construction via an on-site portable self-supporting structural assembly jig. A portable self-supporting vertical wall assembly jig residing at a construction site can include two parallel vertical supports, two perpendicular horizontal supports, and a removable wall platform. The vertical supports can each have one hinge which reduces the height by at least one third. The two perpendicular horizontal supports can include a top horizontal support and a bottom horizontal support. The removable wall platform can be able to be removed after construction of a vertically assembled wall. When the removable wall platform is removed from the jig, the removable wall platform completely can support the wall and can be able to transport the wall to location different from the assembly jig without additional construction equipment. The wall can include a top plate, a bottom plate, and two vertical elements. The top and bottom horizontal support can include spacers which temporarily brace the two vertical elements of the wall during vertical assembly of the wall.

Another aspect of the present invention can include a method for improving the efficiency of construction via an on-site portable self-supporting structural assembly jig. A portable self-supporting vertical wall assembly jig including two parallel vertical supports, two perpendicular horizontal supports, and a removable wall platform can be adjusted to a previously established size. The previously established size of the jig can dictate a size of a wall which can be assembled using the jig. The vertical supports can each have one hinge which can reduce the height by at least one third. The two perpendicular horizontal supports can include a top horizontal support and a bottom horizontal support. A base plate, two vertical elements, and one top plate can be set. The two vertical elements of the wall can be temporarily braced during vertical assembly of the wall by preset spacers of the top and horizontal support. The base plate, two vertical elements, and the one top plate can be secured to each other. The removable wall platform can be removed after construction of the vertically assembled wall. When the removable wall platform is removed from the jig, the removable wall platform can completely support the wall and can be able to transport the wall to location different from the assembly jig without additional construction equipment.

Yet another aspect of the present invention can include a method for improving the efficiency of construction via an on-site portable self-supporting structural assembly jig. A portable self-supporting vertical wall assembly jig can include two parallel vertical supports, two perpendicular horizontal supports, and a removable wall platform can be adjusted to a previously established size. The previously established size of the jig can dictate a size of a wall which can be assembled using the jig. The vertical supports can each have one hinge which reduces the height by at least one third. The two perpendicular horizontal supports can include of a top horizontal support and a bottom horizontal support. A set of spacers of the top and horizontal support of the jig can be set to permit the setting of a base plate. The spacers can be reset to an original position to allow placing of two vertical elements. One top plate can be mated against the two vertical elements to vertically assemble a wall. The base plate, two vertical elements, and the one top plate can be fastened to each other. The removable wall platform can be removed after construction of the vertically assembled wall. When the removable wall platform is removed from the jig, the removable wall platform can completely support the wall and can be able to transport the wall to location different from the assembly jig without additional construction equipment.

BRIEF DESCRIPTION OF THE SEVERAL VIEWS OF THE DRAWINGS

FIG. 1D-2 is a schematic diagram illustrating an embodiment of a spacer arrangement in accordance with an embodiment of the inventive arrangements disclosed herein.

FIGS. 1I and 1J0 illustrates structures for vertically adjusting structures (e.g., walls and roof panels) created with a vertical jig in a vertical position.

DETAILED DESCRIPTION

The present disclosure is a solution for improving the efficiency of construction via an on-site portable structural assembly jig. In one instance, the assembly jig can permit vertical framing and/or construction of structural assemblies such as wall segments, roofing segments, and the like. In one embodiment, the jig can reduce time and the number of skilled workers required to construct structural assemblies. In another embodiment, the jig can improve accuracy and reduce material waste (e.g., dropped nails, screws). For example, rapid construction of structural assemblies via the fabrication jig can be utilized to build a shell of a building quicker and cheaper than traditional on-site/off-site approaches. In embodiments, the vertical jig assembly is able to be secured on an on-sight slab of concrete and used to create square wall segments, roofing segments and the like in a vertical position. These wall/roofing segments are built in place vertically on top of a removable wall platform, in one embodiment, which facilitates the ability to reposition the segments with minimal manual lifting of the constructed segments.

Figure 1A:
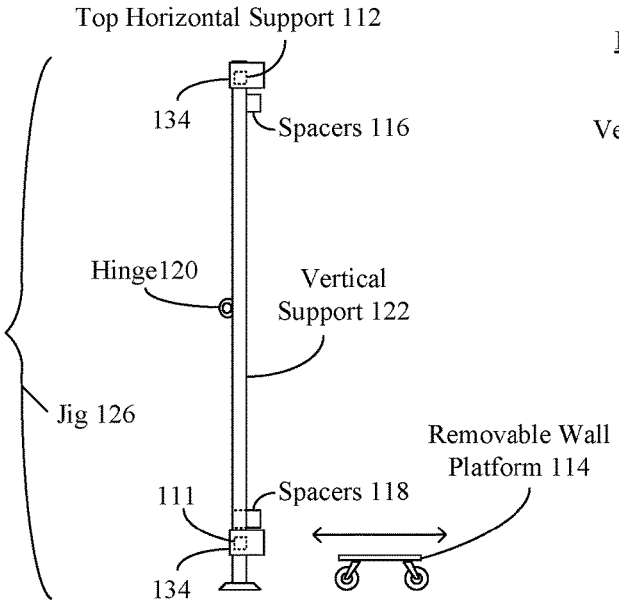
FIG. 1A is a schematic diagram illustrating an embodiment for improving the efficiency of construction via an on-site portable self-supporting structural assembly jig in accordance with an embodiment of the inventive arrangements disclosed herein.

FIG. 1A is a schematic diagram illustrating an embodiment 110 for improving the efficiency of construction via an on-site portable self-supporting structural assembly jig in accordance with an embodiment of the inventive arrangements disclosed herein. Embodiment 110 can be present in the context of embodiment 130, 150, 160, 170, 210, 220, 230, 250, system 300, method 400 and/or embodiment 510, 530, 550.

In embodiment 110, an on-site portable self-supporting structural assembly jig 126 can be utilized to rapidly construct assemblies for a building faster, safer, and cheaper than traditional construction approaches. In the embodiment 110, a assembly jig 126 can permit a construction laborer (e.g., human worker) to build a structural assembly (e.g., wall, wall segment) within jig 126 vertically. In one instance, a laborer can be aided by jig 126 to reduce joint stress, exhaustion (e.g., heat stroke), and the like often associated with long work hours and repetitive actions. In the instance, vertical assembly jig 126 can be utilized to aid in construction tasks including, but not limited to, supporting a structural assembly (e.g., wall) during vertical construction of the assembly, combining wall segments together in a vertical fashion, vertical construction of a roofing segment, vertical transport of a structural assembly from unit (e.g., via platform 114) to a proximate area within a construction site, and the like.

As used herein, a structural assembly can be a physical body or assemblage of bodies in space to form a system capable of supporting loads. Structural assembly can include, but is not limited to, physical structures resulting from construction, deconstruction, and the like. In one embodiment, assembly can include physical structures associated with building structures and non-building structures. Assembly can include, but is not limited to, vertical support elements 155 (e.g., stud), columns, beams, trusses, walls, roofs, floors, and the like. Walls can include, but is not limited to, a curtain wall, a partition wall, an infill wall, a firewall, a sheer wall, a retaining wall, a temporary wall, an exterior wall, an interior wall, a movable partition, a frame (e.g., door frame, window frame), and the like.

As used herein, jig 126 can be a system for permitting the construction of structural assemblies on a construction site. Jig 126 can include aides (e.g., spacers 116, 118, guides 134, wall platform 114) which can assist skilled laborers in structural assembly construction. In one instance, the jig 126 can be associated with a skilled labor pool including, but not limited to, engineers, carpenters, dry wall specialists, plumbers, electricians, and the like. In one embodiment, jig 126 can be a structural assembly system for the vertical fabricating structural assemblies. In the embodiment, jig 126 can reduce the number of skilled laborers necessary for construction of structural assembly by providing support (e.g., of vertical support elements) for the structural assembly during construction. In one embodiment, the jig 126 can include temporary rapid fasteners to secure vertical support elements (e.g., studs) and/or horizontal support elements (e.g., base plate, top plate) during assembly of a wall. In the embodiment, the fasteners can permit a single laborer to assemble and fasten each of the wall elements while the fasteners retain the elements in position. In the embodiment, upon completion of element unification, the fasteners can be disengaged.

It should be appreciated that jig 126 can aid in traditional construction processes including, framing, staging, and the like. For example, jig 126 can enable a single skilled carpenter to rapidly frame and construct an exterior wall vertically within an enclosed space (e.g., gazebo, building) or an open construction site (e.g., slab foundation)

As used herein, a construction site can be a location in which a construction process is performed. Site can include, but is not limited to, a building construction site, a residential construction site, and the like. For example, construction site can be a residential construction site where a set of houses are being built. Site can be associated with one or more construction equipment, resources (e.g., raw materials), skilled laborer pool, and the like.

As used herein, a strut channel can be a standardized formed structural system used in the construction and electrical industries for light structural support, often for supporting wiring, plumbing, or mechanical components such as air conditioning or ventilation system. The strut channel can be usually formed from a metal sheet, folded over into an open channel shape with inwards-curving lips to provide additional stiffness and as a location to mount interconnecting components. The strut channel usually has holes (e.g., or slots) of in the base, to facilitate interconnection or fastening strut to underlying building structures. The strut channel can provide many options for rapidly and easily connecting lengths together and other items to the strut channel, using various specialized strut-specific fasteners and/or bolts. It can be assembled very rapidly with minimal tools and only moderately trained labor, which reduces costs significantly in many applications. The strut channel installation also can often be modified or added-to relatively easily if needed. For example, in US units, the basic typical strut channel forms a box 1⅝ inch by 1⅝ inch or in metric units a 41 mm by 41 mm unit. Strut channel can include, solid channel, punched channel, half slotted, slotted, half channel, and the like. Strut channel can be coupled together with one or more elements including, but not limited to, angle fittings (e.g., L bracket), beam clamps, braces, channel brackets, clevis fittings, end caps, flat fittings, shelf brackets, post bases, pipe clamps, wing fittings, Z fittings, U fittings, and the like.

In one embodiment of the disclosure the on-site portable self-supporting structural assembly jig 126 can be constructed from common off the shelf components. Components can include, but is not limited to, slotted struts (e.g., galvanized channel struts), L-brackets, straight metal plates, bolts and nuts, and the like. In one contemplated embodiment, each individual segment of the jig 126 can have a longitudinal length of eight feet or less, even though the jig 126 once assembled is able to easily assist in creating structural assemblies greater than eight foot in height and length. Use of eight foot or under longitudinal members ensures easier shipping of component parts, as most shipping carriers limit "standard" shipping containers to eight feet in length without significant increases in cost for handling overly large shipments. Frame members that extend over eight feet along a linear direction are constructed of two or more smaller members (each under eight feet linearly) that have been securely coupled together.

In embodiment 110, a side view an on-site portable self-supporting structural assembly jig 126 can be presented. In the embodiment, jig 126 can include, but is not limited to, bottom horizontal support, top horizontal support 112, removable wall platform 114, spacers 116, 118, hinge 120, vertical support 122, guides 134, and the like. In one instance, removable wall support 114 can be moved towards or away from jig 126 before and/or after the completion of a wall structural assembly. In the instance, platform 114 can position a bottom plate of a wall parallel to a bottom horizontal support 111 to permit easy movement of the wall.

Figure 1B:
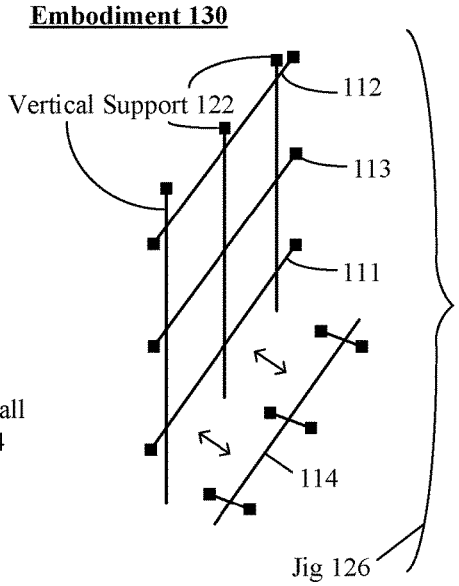
FIG. 1B is a schematic diagram illustrating an embodiment for improving the efficiency of construction via an on-site portable self-supporting structural assembly jig in accordance with an embodiment of the inventive arrangements disclosed herein.
Figure 1C:
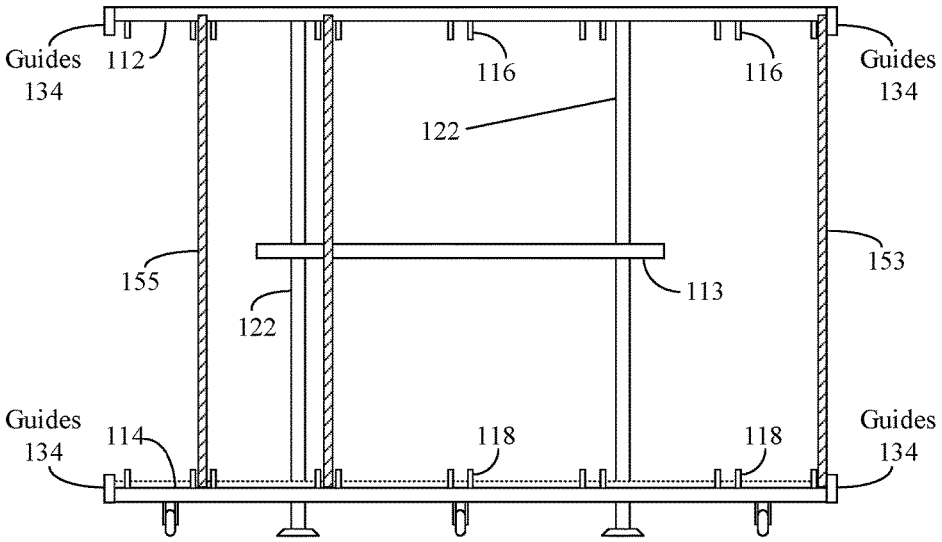
FIG. 1C is a schematic diagram illustrating an embodiment for improving the efficiency of construction via an on-site portable self-supporting structural assembly jig in accordance with an embodiment of the inventive arrangements disclosed herein.
Figures 1, 1D:
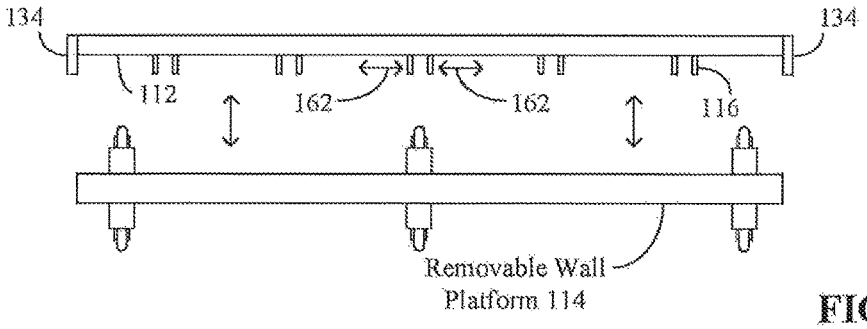
FIG. 1D-1 is a schematic diagram illustrating an embodiment for improving the efficiency of construction via an on-site portable self-supporting structural assembly jig in accordance with an embodiment of the inventive arrangements disclosed herein.
Figures 1, 1D, 2:
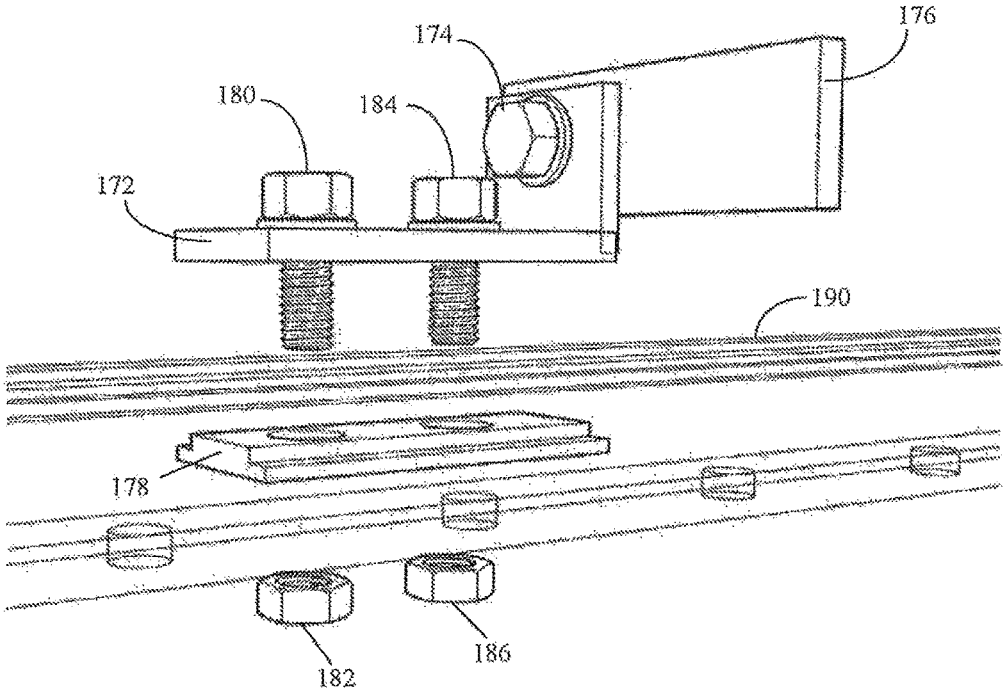
Figure 1E:
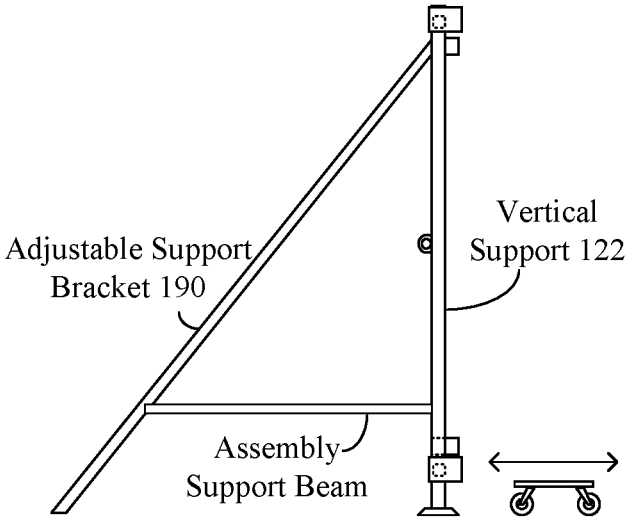
FIG. 1E is a schematic diagram illustrating an embodiment for a vertical jig having adjustable support members.

In one embodiment, shown in FIG. 1E, an adjustable support bracket 190 hinged to vertical support 122 is used to ensure the jig 126 is free standing on a relatively horizontal surface, such as a slab of concrete. The support bracket 190 is able to ensure the vertical support 122 is stabilized at approximately 90 degrees from the horizontal plane, even when this horizontal surface is less than planar. In one embodiment, one or more assembly support beams connect the bracket 190 to the vertical support 122 to increase stability.

FIG. 1B is a schematic diagram illustrating an embodiment 130 for improving the efficiency of construction via an on-site portable self-supporting structural assembly jig in accordance with an embodiment of the inventive arrangements disclosed herein. Embodiment 130 can be present in the context of embodiment 110, 150, 160, 170, 210, 220, 230, 250, system 300, method 400 and/or embodiment 510, 530, 550.

In embodiment 130, a perspective view of jig 126 can present an embodiment with three vertical supports 122 and three horizontal supports 111, 112, 113. In the embodiment, vertical supports 122 can align and brace the horizontal support 111, 112, 113. In one embodiment, platform 114 can align with vertical supports 122 (e.g. hemmed in by guides 134). In the embodiment, platform 114 can include a longitudinal support and perpendicularly mounted mobility rails (e.g., wheels) which can permit the platform 114 to move independently of jig 126.

FIG. 1C is a schematic diagram illustrating an embodiment 150 for improving the efficiency of construction via an on-site portable self-supporting structural assembly jig in accordance with an embodiment of the inventive arrangements disclosed herein. Embodiment 150 can be present in the context of embodiment 110, 130, 160, 170, 210, 220, 230, 250, system 300, method 400 and/or embodiment 510, 530, 550.

In embodiment 150, a front view of jig 126 can be presented. In the embodiment, guides 134 at the terminal ends of bottom and top horizontal support 111, 112 can constrain platform 114 and allow the positioning of end vertical support elements 153 of a structural assembly. In one embodiment, spacers 116, 118 can be used to establish common structural assembly templates for rapid wall construction. In the embodiment, spacers 116, 118 can be easily distributed throughout the length of the jig through the use of conventional tooling (e.g., tape measure, ratchet wrench, pliers). That is, spacers 116, 118 can be set and adjustment can be performed only when a different structural assembly type is to be constructed. For example, spacers 116, 118 can be set during framing of a wall to every 16 inches along the length of the top and bottom horizontal support to allow the placement of studs 16 inches on center.

In one instance, spacers 116, 118 can temporarily support vertical support elements for a structural assembly during creation. In the instance, spacers 116, 118 can be aligned permitting a vertical support element to be supported at the top (e.g., spacer 116) and at the bottom (e.g., spacer 118).

Figure 1F:
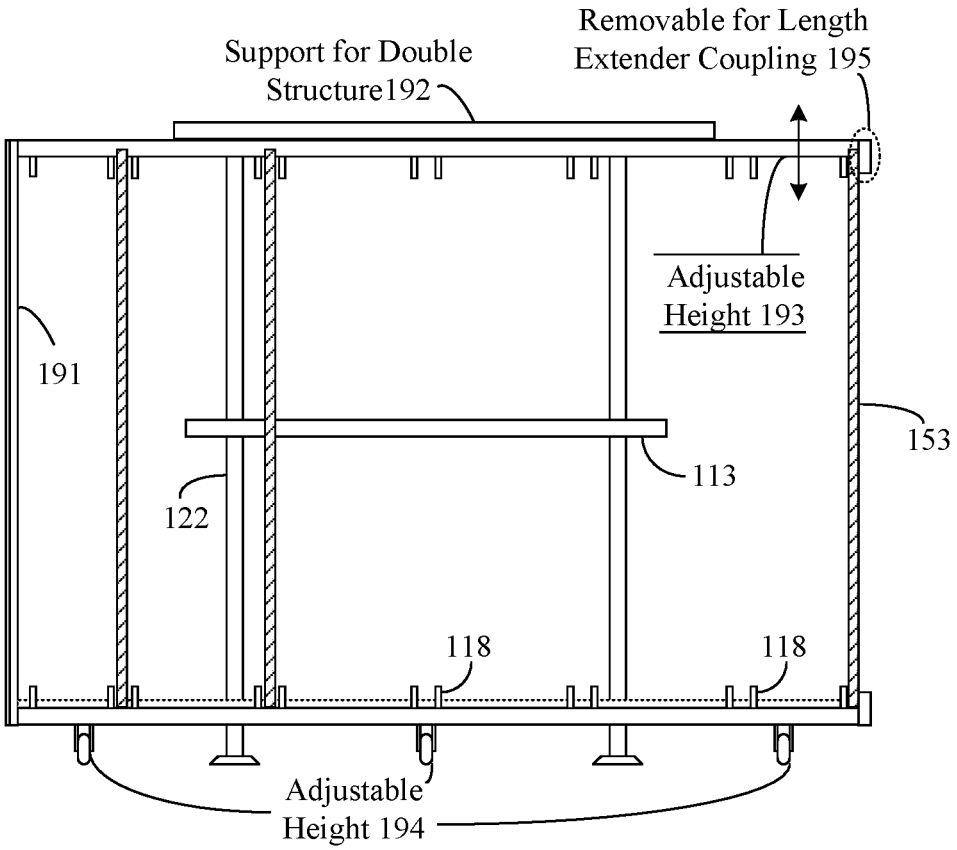
FIG. 1F is a schematic diagram illustrating an embodiment for a verticle jig with vertically adjustable horizontal beams and having a mobile platform allowing for adjustments.

In one embodiment, shown in FIG. 1F, a horizontal guide 191 (which includes two planes meeting at a ninety degree angle, is able to be used instead of the end guides 134. Use of an elongated guide 191 that extends vertically from top to bottom of the jig 126 is preferred in some embodiments as it aids in supporting an edge of the wall or roofing segment being constructed. Additionally, a support for a double structure 192 is contemplated, which provides additional support when two two-by-fours or other doubled wall/roof endpoint is being constructed. A construction worker can stack two four-by-fours in position, one on top of the other (guided and supported by structure 192), which ensures positioning is maintained as these elements are secured to each other, such as through screws/bolts/welding. In one embodiment, a vertical height of the horizontal members are adjustable (as noted by adjustable height 193). This permits a construction of an eight foot segment of wall/roofing or less. In one embodiment, the vertical height of the upper horizontal element is approximately eight feet to eight feet four inches. Other heights are possible depending on a desired size of a wall/ceiling member. The horizontal length by default of the jig 126 can be approximately eight feet, to accommodate a standard wall segment. When a sixteen feet horizontal wall/roofing segment is desirable, two eight foot segments can be joined to one another. When a twenty four foot horizontal segment is desired, three eight foot segments can be joined horizontally, and so forth. In one embodiment, an end guide 132 or guide rail is designed to be removable, which permits an easily coupling/extending of horizontal jig segments to each other.

Figure 1G:
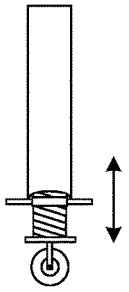
FIG. 1G is a schematic diagram illustrating an embodiment for adjusting a height of a removable wall platform.
Figure 1H:
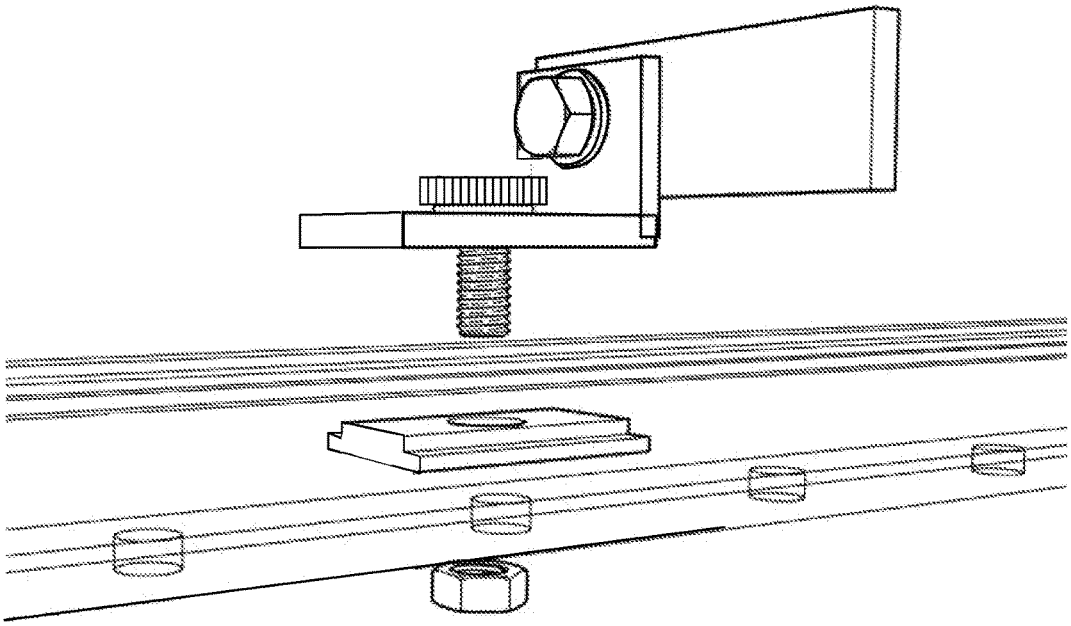
FIG. 1H is a schematic diagram illustrating an embodiment for adjusting beams and other support members on a vertical jig as detailed herein.
Figure 1I:
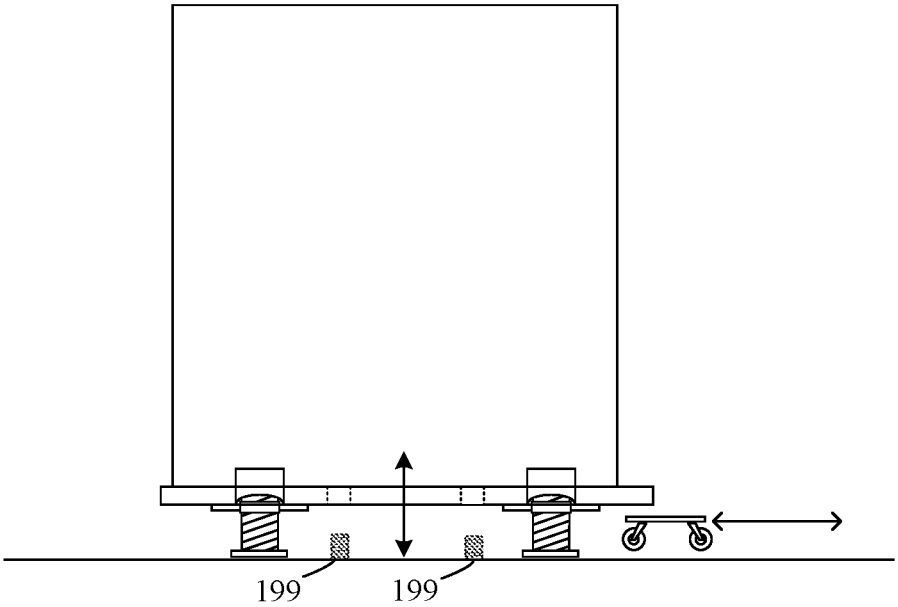
Figure 1J:
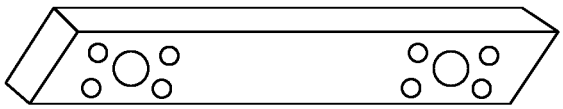
Figure 1K:
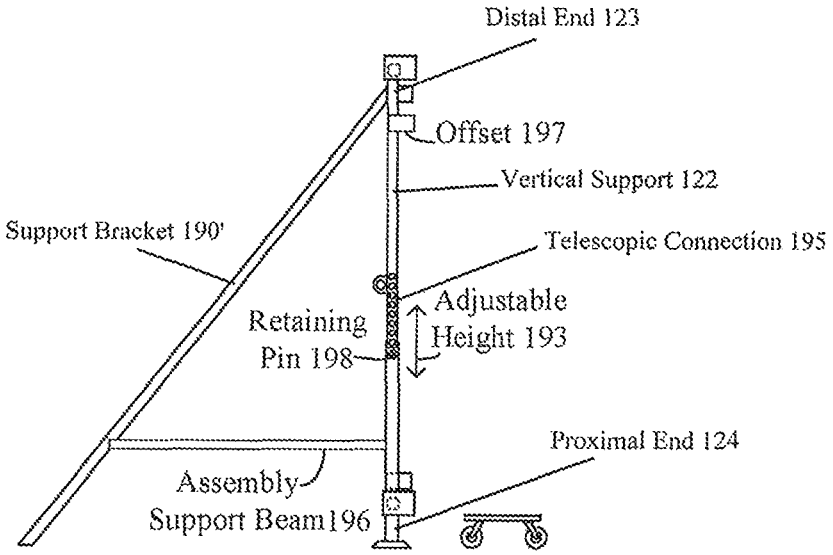
FIG. 1K illustrates vertically adjusting height of the jig members.

Adjusting the height (193) of the jig is also illustrated by an embodiment shown in FIG. 1K. In FIG. 1K, a vertical support 122 is shown comprising a telescopic connection 195. The telescopic connection may comprise an outer perimeter of a metal sleeve that fits inside an inner perimeter of a base, effectively making an upper element fit inside a base member. The upper member extends upwards and downwards, similar to a structure used to adjust a support of a weight bench and other exercise equipment. In FIG. 1K, a support bracket 190' is connected to a vertical support 122 around a distal end 123 thereof. Further, an assembly support beam 196 is connected to the vertical support 122. The assembly support beam 196 may be connected to the vertical support 122 around a proximal end 124 thereof. The assembly support beam may be connected in a substantially perpendicular alignment to the vertical support 122. A removable retaining pin 198, which is able to be implemented as a gender mated screw-based coupler in one embodiment, is used to retain the relative position of the top member to the base member at a desired height. Thus, a simple adjustment can permit the upper member to periscope upwards and downwards to create a desired height for the top-most support (or support 192) in a contemplated embodiment. An offset 197 is able to be added to an upper member to ensure wall-structures created with the jig are properly positioned. That is, since, the upper member of the jig fits inside the base member of the jig, allowing for vertical repositioning, the offset 197 ensures that an effective planar surface (vertically) exists, so that wooden members (e.g., 2×4's or metal wall elements) are vertically "flush" despite the difference in vertical jig member width. Hence, the lower width and the upper width (with the offset 197) for supporting wooden 2×4's or other wall forming structures are properly aligned by the jig.

FIG. 1F also shows that a height (adjustable height 194) of the rollers of the removable wall platform 114 are able to be vertically adjusted. Similarly, bottoms of the jig's vertical members are able to be adjusted. These adjustments ensures that square wall and ceiling support members are able to be constructed even if the surface upon which the jig rests is non-level. Being level relative to the horizontal is not necessary for the vertical jig to function properly, so long as horizontal and vertical beams of the wall/roofing structures are able to be squared (at 90 degrees) via the jig 126.

In another embodiment, an adjustable square 580 is integrated into a bottom horizontal support 552 (or other suitable location) of the vertical jig. This square is used to ensure that the base of the wall being constructed (which rests on the removable wall platform 554 is square (horizontal member rests on the wall platform 554, vertical member is supported by jig (as in FIG. 1K, where the vertical member would rest upwardly on the offset 197). The use of the square (in conjunction with an ability to adjust the level of elements (such as shown by FIG. 1G, which includes level adjustments to the wall platform 554) ensures that a 90 degree angle is created in the wall/roofing structures even if a surface (e.g., the concrete slab) is less than level.

Although there are a number of contemplated ways (including hydraulic and pneumonic vertical adjustment mechanisms), in one embodiment, a manual screw is able to be used to adjust platform 114 and jig beam heights, as shown by FIG. 1G. Specifically, a screwable coupler is imposed between the bottom of a wheel (or other base) and the vertically extending member, which permits vertical adjustments, as shown.

As previously mentioned, the jig 126 assembly components are adjustable in height and distance (193, 194). Various adjustment mechanisms are contemplated, such as that elaborated upon in FIG. 1D-2. FIG. 1H shows an alternative, were instead of utilizing two bolts (180 and 184) a single turnable screw is used, which makes manually adjusting the assembly components easier. There, the use of a single screw (which is offset from the vertical bolt to ensure that it is not "caught" as it is adjusted vertically replaces the two bolts shown for FIG. 1D-2. Similar adjustments are contemplated through the disclosure and are to be consider within scope of the disclosure.

FIG. 1D-1 is a schematic diagram illustrating an embodiment 160 for improving the efficiency of construction via an on-site portable self-supporting structural assembly jig in accordance with an embodiment of the inventive arrangements disclosed herein. Embodiments 160, 170 can be present in the context of embodiment 110, 130, 150, 210, 220, 230, 250, system 300, method 400 and/or embodiment 510, 530, 550.

In embodiment 160, a top view of a jig 126 can be presented. In the embodiment, spacers 116, 118 can be dynamically adjusted to permit the construction of any structural assembly. In the embodiment, spacers can be adjusted 162 to accommodate a larger vertical support element size (e.g., away from each other) or adjusted 162 to accommodate a smaller vertical support element size (e.g., towards each other). That is, the spacers of jig 126 can be easily changed to meet varying requirements of a construction site. It should be noted that the removable wall platform 114 has adjustable wheels (see FIG. 1G) in embodiments and is able to be utilized to move a vertically positioned wall into a desired location without having to manually lift the wall segment (or roofing segment) that is constructed via the jig 126. In one embodiment, one or more lifters (See FIG. 1I) are able to be used to vertically lift the wall/roofing segment (with a screwing action to achieve mechanical advantage). Once raised, the removable platform 114 is removed by rolling it out of the way. After removed, the screws are turned to vertically lower the wall/roofing segment. One way to achieve this vertical lift/drop is by creating holes in the bottom horizontal element of the wall/roofing segment, as shown by FIG. 1J. That is, a set of four screws are able to secure the screwable member in place (placed at the center), which after it is used to raise/lower the wall/roofing segment for removable of the wall platform 114, the vertical adjustors are able to be removed. This arrangement ensures that even a minimally manned crew can safely reposition wall segments into position with a minimal amount of human labor/strain. Other mechanisms (such as a hydrolic jack or other temporary mechanisms used to raise/lower each segment are contemplated). Use of a screw-based lifter temporarily attached to the wall/roofing member itself is an easy low-tech solution when other specialized mechanisms are unavailable on site (as expressed by FIGS. 1I and 1J).

By permitting the wall/ceiling structures to be vertically raised and lowered, a number of protrusions 199 can be pre-inserted into the concrete slab before the wall is positioned (by moving the removable wall platform 114) over top of the position in which it is intended to be inserted. It is much easier to add the protrusions 199 (e.g., screw members in embodiments) into the slab before a wall is positioned. These protrusions 199 fit into holes drilled into the lower base plate (horizontal 2×4) of the wall member. Instead of having to manually lift the wall vertically and slide it into place (which is a manual effort that causes damage and worker strain), the wall member is rolled into proper alignment, lifted (as shown by FIGS. 1I and 1J) to permit the wall platform to be removed, then lowered into place with minimal manual strain or wall member stress.

The removable wall platform 1I is shown off-scale in FIG. 1I to permit the illustration of other components. Note from FIGS. 5C, 6A, and 6B that the wall support platform is able support the lower horizontal member of the wall/ceiling structure (e.g., a horizontal 2×4) as it is being built via the vertical jig and as it is being repositioned (via the wheels of the removable wall platform) on site.

Embodiment 170 illustrates a detailed view of an exemplary spacer arrangement. In the embodiment, spacers 116, 118 can include multiple elements including, but not limited to, bracing elements, sliding elements, fastening elements, and the like. In one instance, spacers can be assembled from L brackets, straight plates, nuts and bolts. In the embodiment, L bracket 172 can be affixed to a slide plate 178 via two or more bolts 180, 184 which can be secured in placed via bolts 182, 186 to support 190' and a spacer plate 176 can be secured vertically or horizontally via bolt and nut 174. For example, bracket 172 can be a 90 Degree 4-Hole Galvanized Angle bracket, plate 176 can be a 3½ in. Flat Straight Bracket, plate 176 can be a 3½ in. 2-Hole Flat Straight Slotted Strut Bracket which can be affixed together with a ½ inch Hex Head bolt, 1-inch washer, and Hex nut onto a 12-Gauge and/or 14-Gauge strut channel.

In the embodiment, loosening the bolts 180,184 can allow spacer 116, 118 to be adjusted (e.g., slid along channel of support 190') and the spacer 116, 118 can be secured by fastening bolts 180, 186. It should be appreciated that the bolts and nuts can be standard couplers which can conform to metric system sizes, imperial system sizes (e.g., SAE), and the like. For example, spacer 116, 118 can be easily adjusted via a SNAP-ON ratchet wrench and a 1/4 inch drive coupler. As noted, the bolts (180, 184) are able to be replaced with a single turnable screw (FIG. 1H) in embodiments for ease of adjustments.

Drawings presented herein are for illustrative purposes only and should not be construed to limit the invention in any regard. It should be appreciated that assembly jig can include, removable elements, non-removable elements, and the like. For example, assembly jig can accommodate the use of traditional building tools including, but not limited to, framing tools (e.g., clamps), fastener tools (e.g., nail gun), and the like. It should be appreciated that horizontal and/or vertical supports of the disclosure can utilize traditional strut channel, framing channel, and the like. It should be appreciated that supports can be made of any traditional and/or proprietary material and is not limited to metal, aluminum, and the like. That is, any material which provides strength and stability can be leveraged. In one instance, vertical and/or horizontal supports can be fabricated from carbon fiber or thermoplastic (e.g., TEGRIS).

Figure 2A:
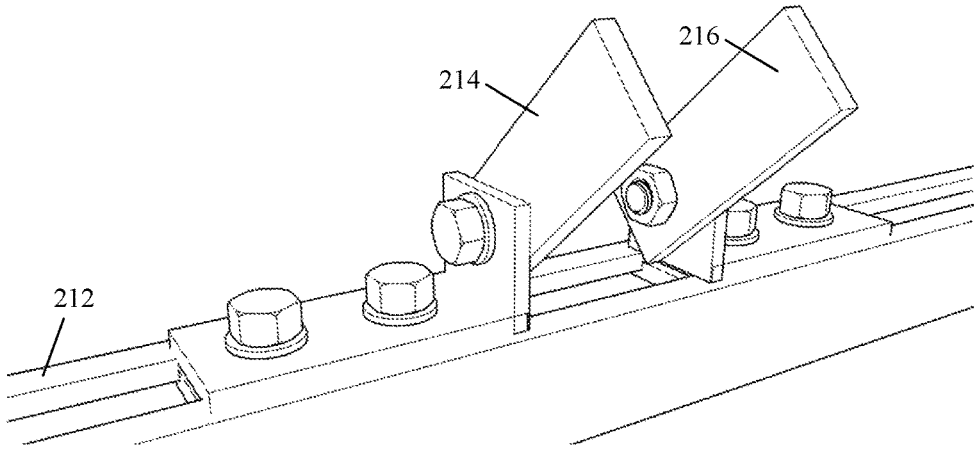
FIG. 2A is a schematic diagram illustrating an embodiment for improving the efficiency of construction via an on-site portable self-supporting structural assembly jig in accordance with an embodiment of the inventive arrangements disclosed herein.
Figure 2A:
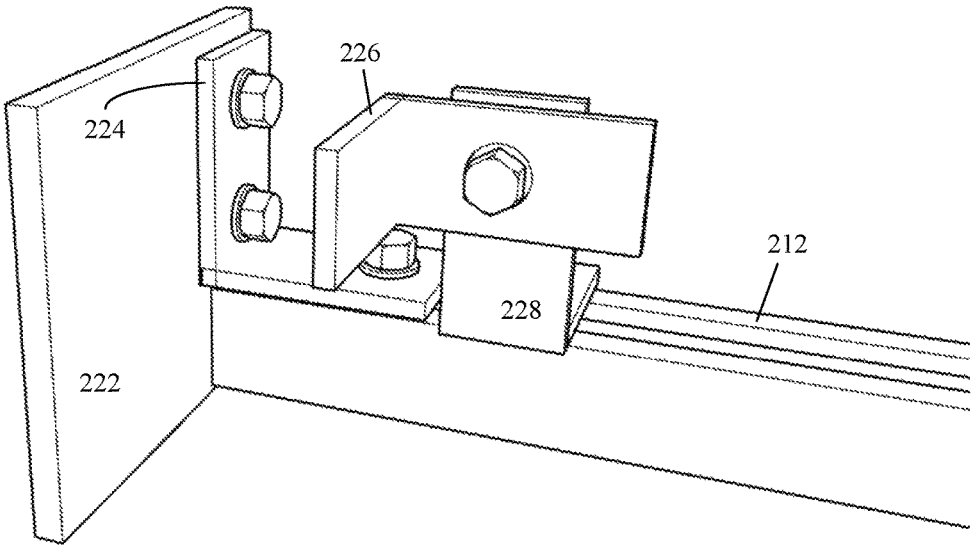

FIG. 2A is a schematic diagram illustrating an embodiment 210 for improving the efficiency of construction via an on-site portable self-supporting structural assembly jig in accordance with an embodiment of the inventive arrangements disclosed herein. Embodiments 210, 220 can be present in the context of embodiment 110, 130, 150, 160, 170, 230, 250, system 300, method 400 and/or embodiment 510, 530, 550.

Embodiment 210 illustrate spacers 214, 216 able to be rotated from a vertical position (e.g., to position a base plate or top plate) to a horizontal position and conversely. It should be appreciated that spacers 214, 216 can be rotated independently allowing vertical supports to be placed from either direction (e.g., when not slotted in between spacers).

Embodiment 220 illustrate a terminal end (e.g., bottom horizontal support 212) of the jig of the disclosure. In one instance, the terminal end can include an L bracket 224 fastened to a rectangular plate 222 perpendicular to the support 212. In the instance, an L-bracket 228 can be secured to support 212 to allow a different L bracket 226 to be perpendicularly placed (e.g., parallel to plate 222).

Figure 2B:
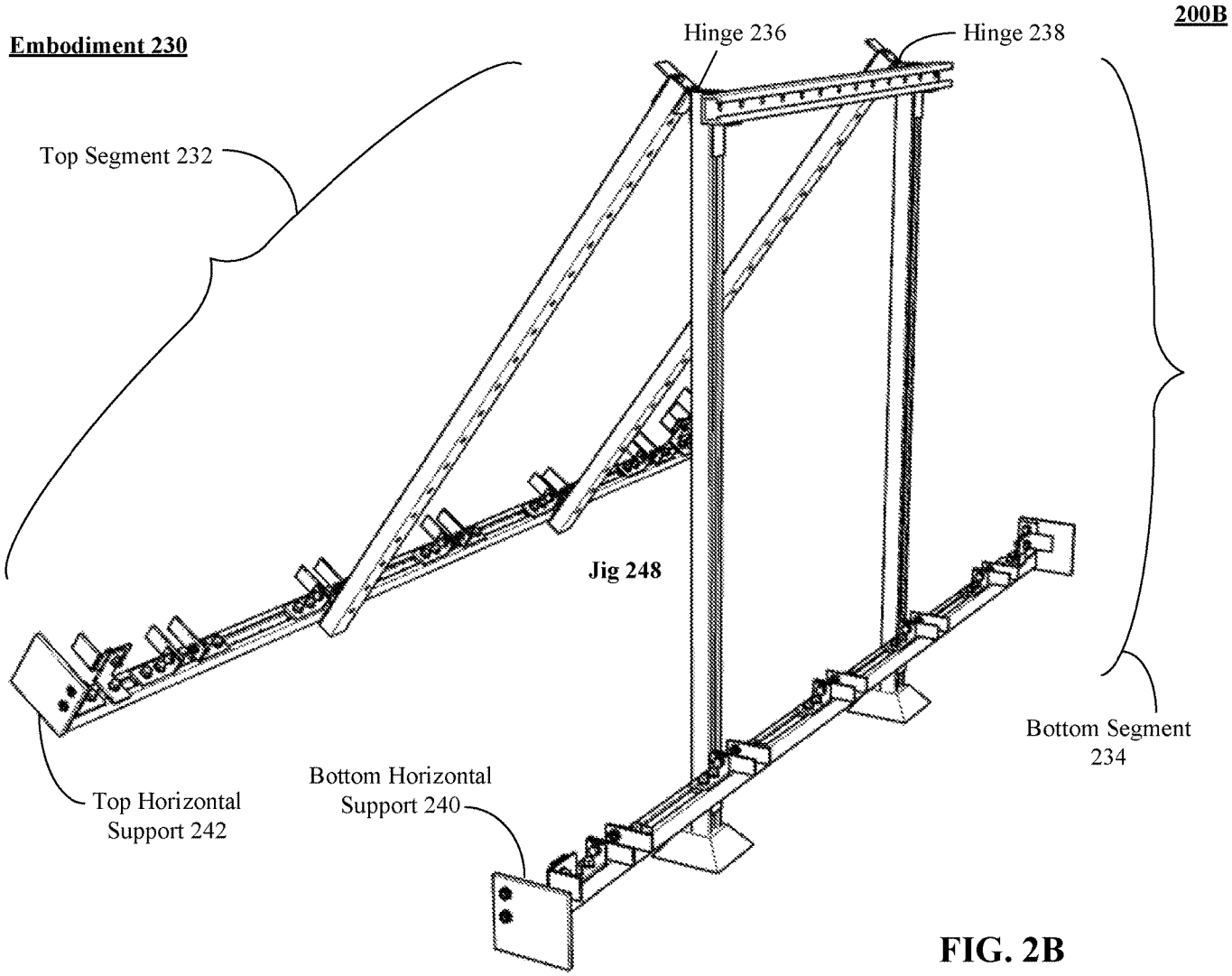
FIG. 2B is a schematic diagram illustrating an embodiment for improving the efficiency of construction via an on-site portable self-supporting structural assembly jig in accordance with an embodiment of the inventive arrangements disclosed herein.
Figure 2C:
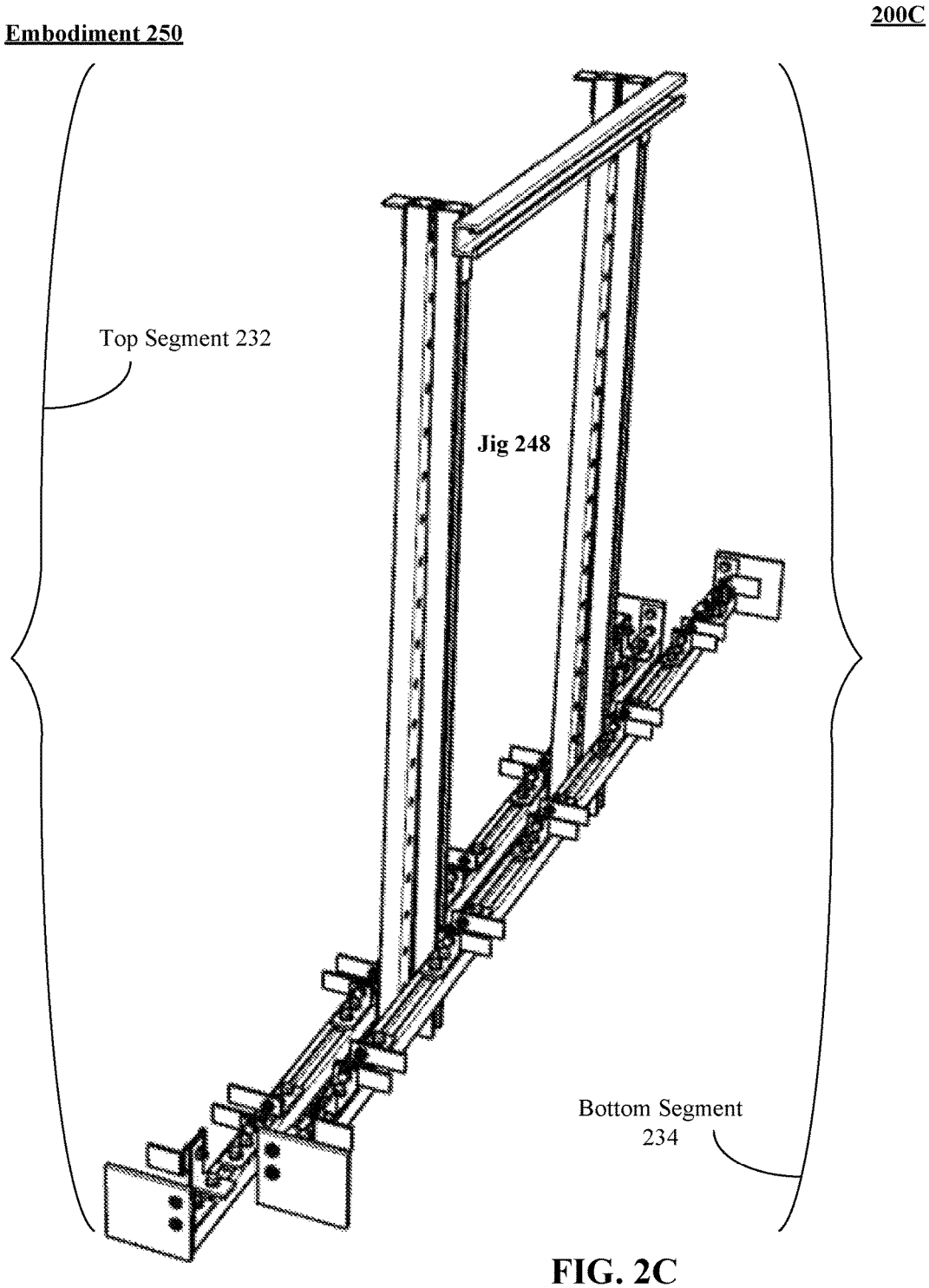
FIG. 2C illustrates an embodiment of a completed folding of a jig with top segment folded against bottom segment.

FIG. 2B is a schematic diagram illustrating an embodiment 230 for improving the efficiency of construction via an on-site portable self-supporting structural assembly jig in accordance with an embodiment of the inventive arrangements disclosed herein. Embodiments 230, 250 can be present in the context of embodiment 110, 130, 150, 160, 170, 210, 220, system 300, method 400 and/or embodiment 510, 530, 550.

Embodiment 230 illustrates an exemplary folding of the jig 248 of the disclosure. In the embodiment, a top segment 232 can include a top horizontal support 242, two or more vertical supports, and the like. In the embodiment, bottoms segment 234 can include a bottom horizontal support 240, two or more vertical supports, and the like. In one instance, hinges 236, 238 can permit top segment 232 to fold back against bottom segment 234.

Embodiment 250 can illustrate a completed folding of jig 248 with top segment 232 folded against bottom segment 234. In the embodiment, the folded jig 248 can be easily transported within a conventional vehicle (e.g., pickup truck).

It should be appreciated that the jig 248 can be deconstructed and reconstructed for purposes of transportation and is not limited to the exact arrangement of embodiment 250.

Figure 3:
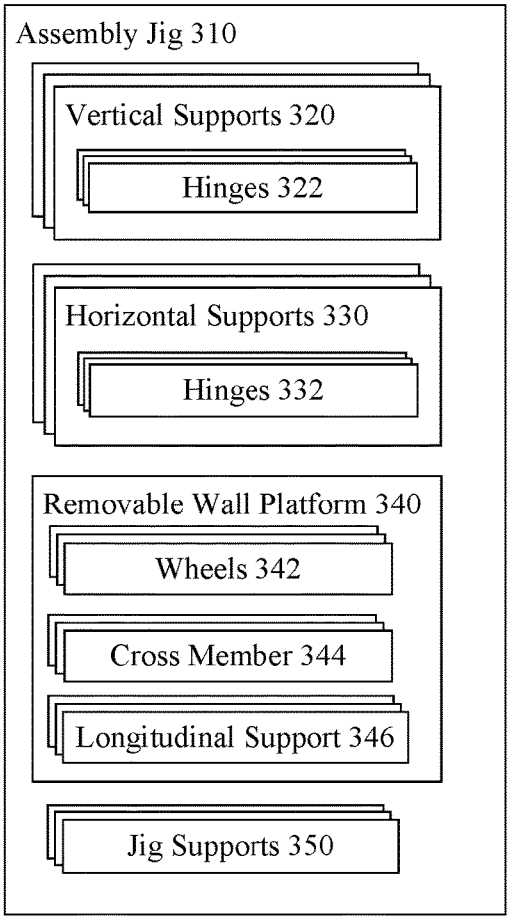
FIG. 3 is a schematic diagram illustrating a system for improving the efficiency of construction via an on-site portable self-supporting structural assembly jig in accordance with an embodiment of the inventive arrangements disclosed herein.

FIG. 3 is a schematic diagram illustrating a system 310 for improving the efficiency of construction via an on-site portable self-supporting structural assembly jig in accordance with an embodiment of the inventive arrangements disclosed herein. System 300 can be present in the context of embodiment 110, 130, 150, 160, 170, 210, 220, 230, 250, method 400 and/or embodiment 510, 530, 550.

An assembly jig 310 can include vertical supports 320, horizontal supports 330, removable wall platform 340, jig supports 350, spacers, adjustment tooling, and the like. In one embodiment, jig 310 can be include one or more customized parts which can be manufactured using traditional and/or proprietary processes. In the embodiment, manufacturing processes can include, but is not limited to, 3*d* printing, extrusion molding, blow molding, and the like.

Vertical support 320 can include hinges 322 which can a be mechanical bearing that connects two solid objects, typically allowing only a limited angle of rotation between them. Hinges 322 can conform to traditional and/or proprietary type and functionality which can include, but is not limited to, spring hinge, barrel hinge, pivot hinge, concealed hinge, flushed hinge, a living hinge, and the like.

Horizontal supports 330 can include hinges which can a be mechanical bearing that connects two solid objects, typically allowing only a limited angle of rotation between them. Hinges 332 can conform to traditional and/or proprietary type and functionality which can include, but is not limited to, spring hinge, barrel hinge, pivot hinge, concealed hinge, flushed hinge, a living hinge, and the like.

Removable wall platform 340 can include, but is not limited to, wheels 342, cross member 344, longitudinal support 346, and the like. Platform 340 can include a substantially flat surface (e.g., longitudinal support 346) parallel to a ground surface. In one instance, cross members 344 can be perpendicular to the longitudinal support 346. In the instance, the members 344 can be affixed with wheels 342 to enable platform 340 to move independently of jig 310.

Jig supports 350 can be one or more structural elements which can permit the jig 310 to be self-supporting. In one instance, support 350 can include, but is not limited to, vertical support elements, horizontal support elements, diagonal support elements, and the like. In the instance, supports 350 can be affixed to the rear face of jig 310 and can be removable, non-removable, and the like. It should be appreciated that supports 350 can be an optional component of the jig 310.

Drawings presented herein are for illustrative purposes only and should not be construed to limit the invention in any regard. In one instance, supports 320, 330 can include telescoping properties, folding capabilities, and the like. In one embodiment, the jig 310 can be easily extended and/or collapsed to construct structural assemblies of varying sizes. That is, using common off the shelf components, the horizontal and/or vertical supports can be replaced easily with shorter or longer elements with minimal effort. For example, to extend the jig to support a twelve foot wall construction, the horizontal supports can be replaced from an eight foot slotted strut to a twelve foot slotted strut and additional spacers can be easily bolted on to accommodate the additional wall studs needed for the wall size.

In one embodiment, jig 310 can include additional elements and/or tooling including, but not limited to, a threaded hole straight bolt-on plate, a threaded rod, and the like. In the embodiment, threaded hole straight bolt-on plate and threaded rod can be utilized to move and/or position a structural assembly onto a foundation slab. For example, two 48 inch threaded rods can each be secured into each of two threaded hole set plates affixed to a base plate of a wall to enable a laborer to move the removable platform 340 into a position in where the wall can be secured. In one embodiment, the threaded rods can be threaded through straight bolt-on plate and extend below the bottom surface of the base plate to support the wall. In the embodiment, removable wall platform 340 can be removed allowing the wall to be set onto anchors within a ground surface. For example, the threaded rods can hold up the wall while the rolling wall platform can be moved out of the way allowing rods to be decoupled to lower the wall onto J bolts of a foundation slab.

It should be appreciated that the disclosure is not limited to, a threaded hole straight bolt-on plate and a threaded rod, and can utilize any traditional and/or proprietary means for positioning a structural assembly using removable wall platform 340.

Figure 4:
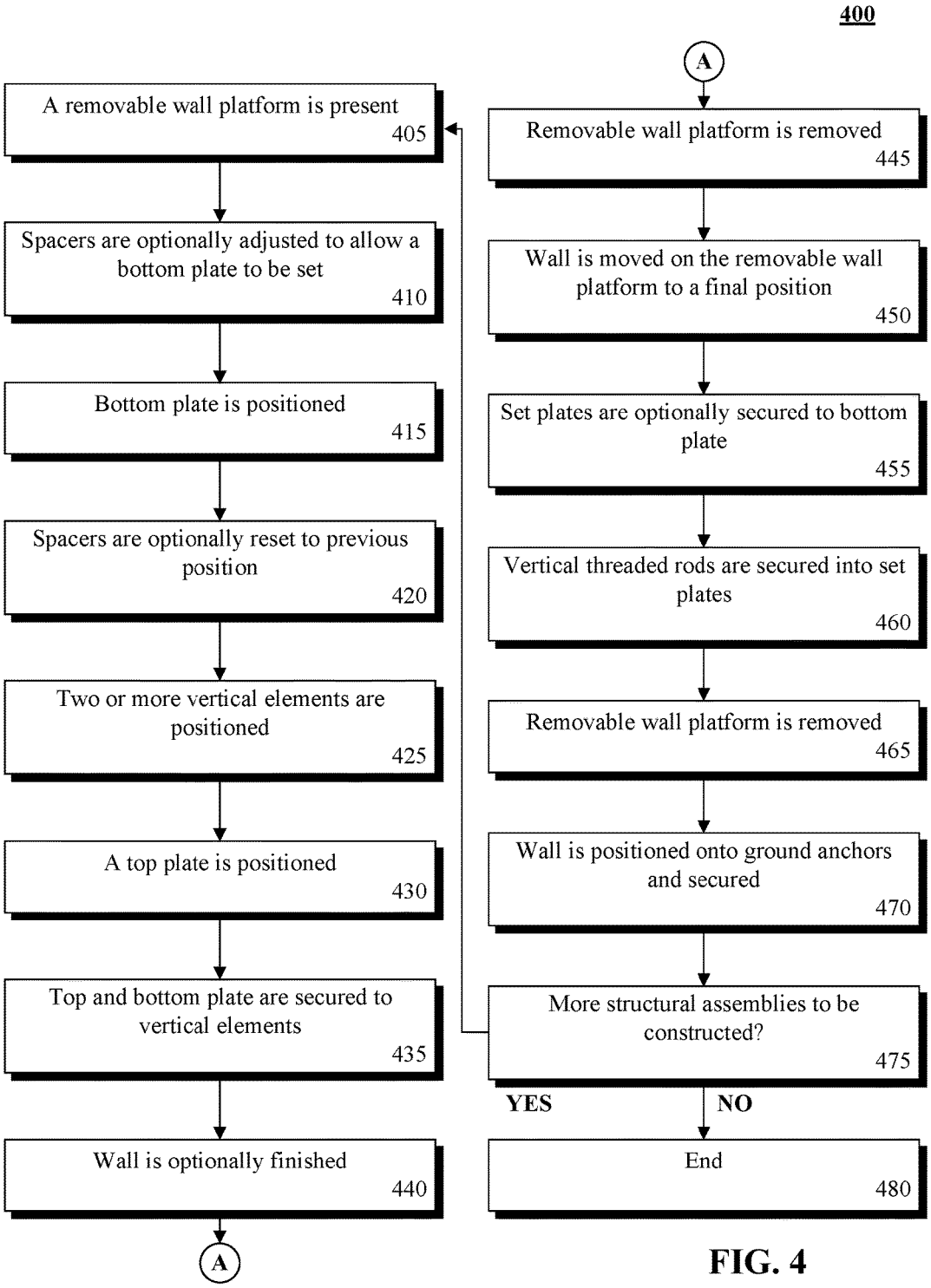
FIG. 4 is a flowchart illustrating a method for improving the efficiency of construction via an on-site portable self-supporting structural assembly jig in accordance with an embodiment of the inventive arrangements disclosed herein.

FIG. 4 is a flowchart illustrating a method 400 for improving the efficiency of construction via an on-site portable self-supporting structural assembly jig in accordance with an embodiment of the inventive arrangements disclosed herein. Method 400 can be performed in real-time or near real-time. Method 400 can be present in the context of embodiment 110, 130, 150, 160, 170, 210, 220, 230, 250, system 300, and/or embodiment 510, 530, 550.

In step 405, a removable wall platform can be present. In step 410, spacers can be optionally adjusted to allow a bottom plate of a wall to be set. In step 415, the bottom place can be positioned. In step 420, spacers can be optionally reset to a previous position. In step 425, two or more vertical elements can be positioned. In step 430, a top plate can be positioned. In step 435, top and bottom plate can be secured to vertical elements. In step 440, the wall can be optionally finished. In step 445, the removable wall platform can be removed. In step 450, the wall can be moved on the platform to a final position. In step 455, a set of plates can be optionally secured to the bottom plate. In step 460, a set of vertical threaded rods can be secured into set plates. In step 465, the removable wall platform can be removed. In step 470, the wall can be positioned onto ground anchors and secured. In step 475, if more structural assemblies are to be constructed the method can return to step 405, else continue to step 480. In step 480, the method can end.

Figure 5A:
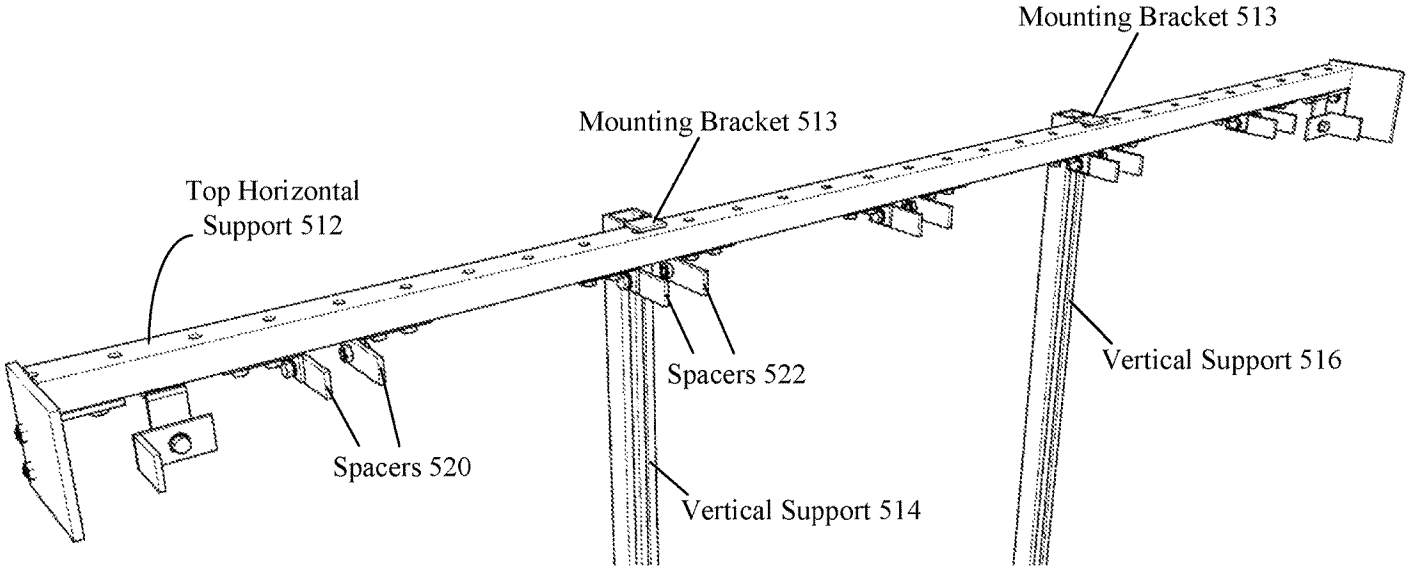
FIG. 5A is a schematic diagram illustrating an embodiment for improving the efficiency of construction via an on-site portable self-supporting structural assembly jig in accordance with an embodiment of the inventive arrangements disclosed herein.

FIG. 5A is a schematic diagram illustrating an embodiment 510 for improving the efficiency of construction via an on-site portable self-supporting structural assembly jig in accordance with an embodiment of the inventive arrangements disclosed herein. Embodiments 510 can be present in the context of embodiment 110, 130, 150, 160, 170, 210, 220, 230, 250, system 300, method 400 and/or embodiment 530, 550.

Embodiment 510 can illustrate a close up view of a top segment of an assembly jig. Top segment can include a horizontal support 512, support mounting brackets 513, vertical support 514, 516, spacers 520, 522, and the like.

Figure 5B:
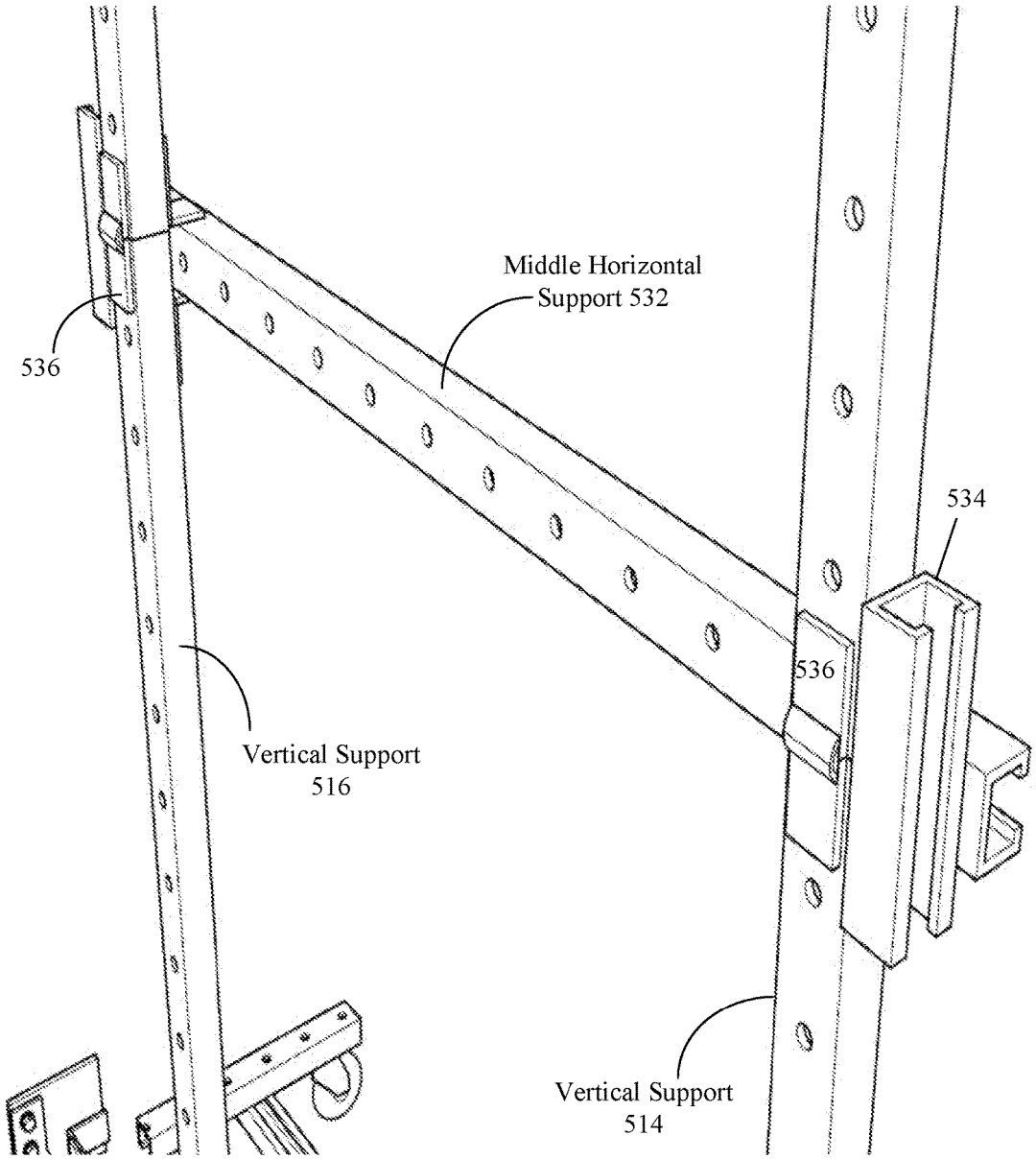
FIG. 5B is a schematic diagram illustrating an embodiment for improving the efficiency of construction via an on-site portable self-supporting structural assembly jig in accordance with an embodiment of the inventive arrangements disclosed herein.

FIG. 5B is a schematic diagram illustrating an embodiment 530 for improving the efficiency of construction via an on-site portable self-supporting structural assembly jig in accordance with an embodiment of the inventive arrangements disclosed herein. Embodiments 530 can be present in the context of embodiment 110, 130, 150, 160, 170, 210, 220, 230, 250, system 300, method 400 and/or embodiment 510, 550.

Embodiment 530 can illustrate a close up view of a middle segment of an assembly jig. Middle segment can include a middle horizontal support 532, hinges 536, stabilizer plates 534, vertical support 514, 516, and the like. In one embodiment, two halves of vertical supports 514, 516 can be connected via a 4 hole hinge, a 2 hole hinge, and the like. In the embodiment, the two halves can be secured together using stabilizer plates 534 when the jig is in use and/or deployed. For example, the two halves of the vertical supports 514, 516 can be hinged together via a 1⅝" 4 Hole Hinge with stabilizer plates 534 affixed to the outer sides of the two halves to permit the two halves to function as a single unified strut.

Figure 5C:
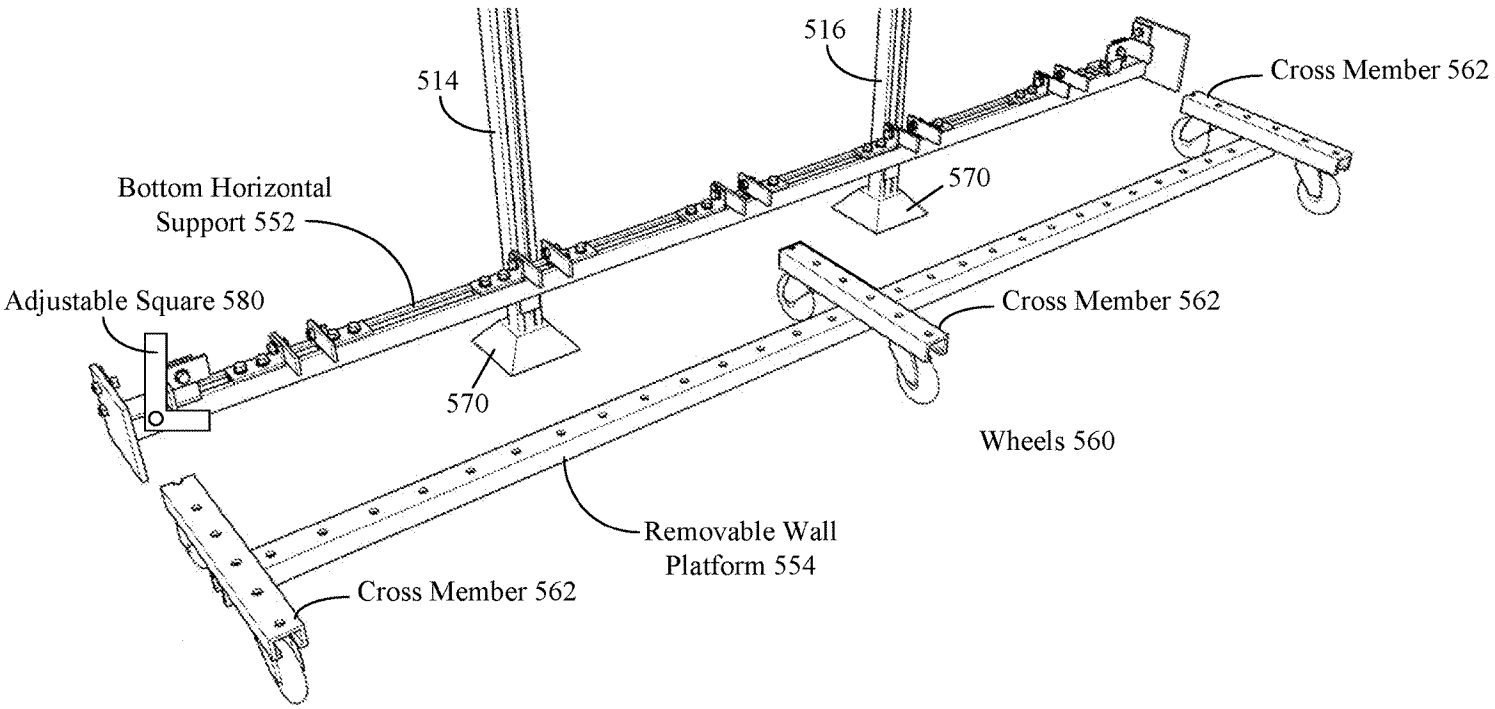
FIG. 5C is a schematic diagram illustrating an embodiment for improving the efficiency of construction via an on-site portable self-supporting structural assembly jig in accordance with an embodiment of the inventive arrangements disclosed herein.

FIG. 5C is a schematic diagram illustrating an embodiment 550 for improving the efficiency of construction via an on-site portable self-supporting structural assembly jig in accordance with an embodiment of the inventive arrangements disclosed herein. Embodiments 550 can be present in the context of embodiment 110, 130, 150, 160, 170, 210, 220, 230, 250, system 300, method 400 and/or embodiment 510, 530.

Embodiment 550 can illustrate a close up view of a bottom segment of an assembly jig. Bottom segment can include a bottom horizontal support 552, removable wall platform 554, and the like. In one instance, each of the vertical supports 514, 516 can be stabilized onto a ground plate 570 temporarily and/or permanently via square mount post base. In the instance, the ground plate 570 can be secured to a ground surface via traditional and/or proprietary coupling anchors. For example, the ground plate 570 can be bolted onto a moveable construction platform via ⅝ inch lag screws.

In one embodiment, the cross members 562 can be positioned on top of a caster arm (see FIG. 1G), which ensures that both the cross member and the caster arm(s) are adjustable. Placement of the cross members 562 (per the adjustments) are based on a thickness of a wall segment being utilized. Thus, the wall platform 554 is able to be adjusted to accommodate any reasonable size wall/roofing segment within a significant variance of size/thickness.

Figure 6A:
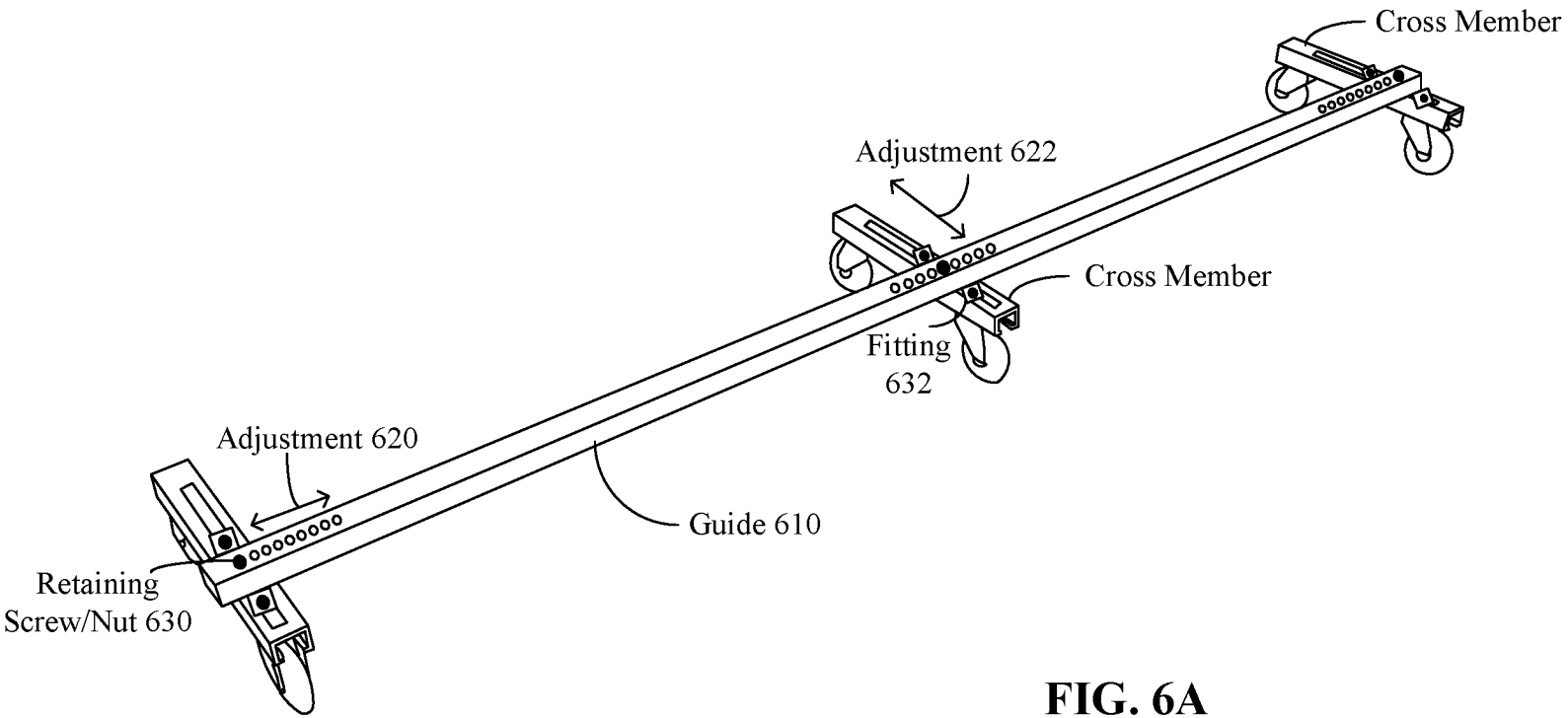
FIG. 6A illustrates an embodiment of the removable wall platform with a guide.
Figure 6B:
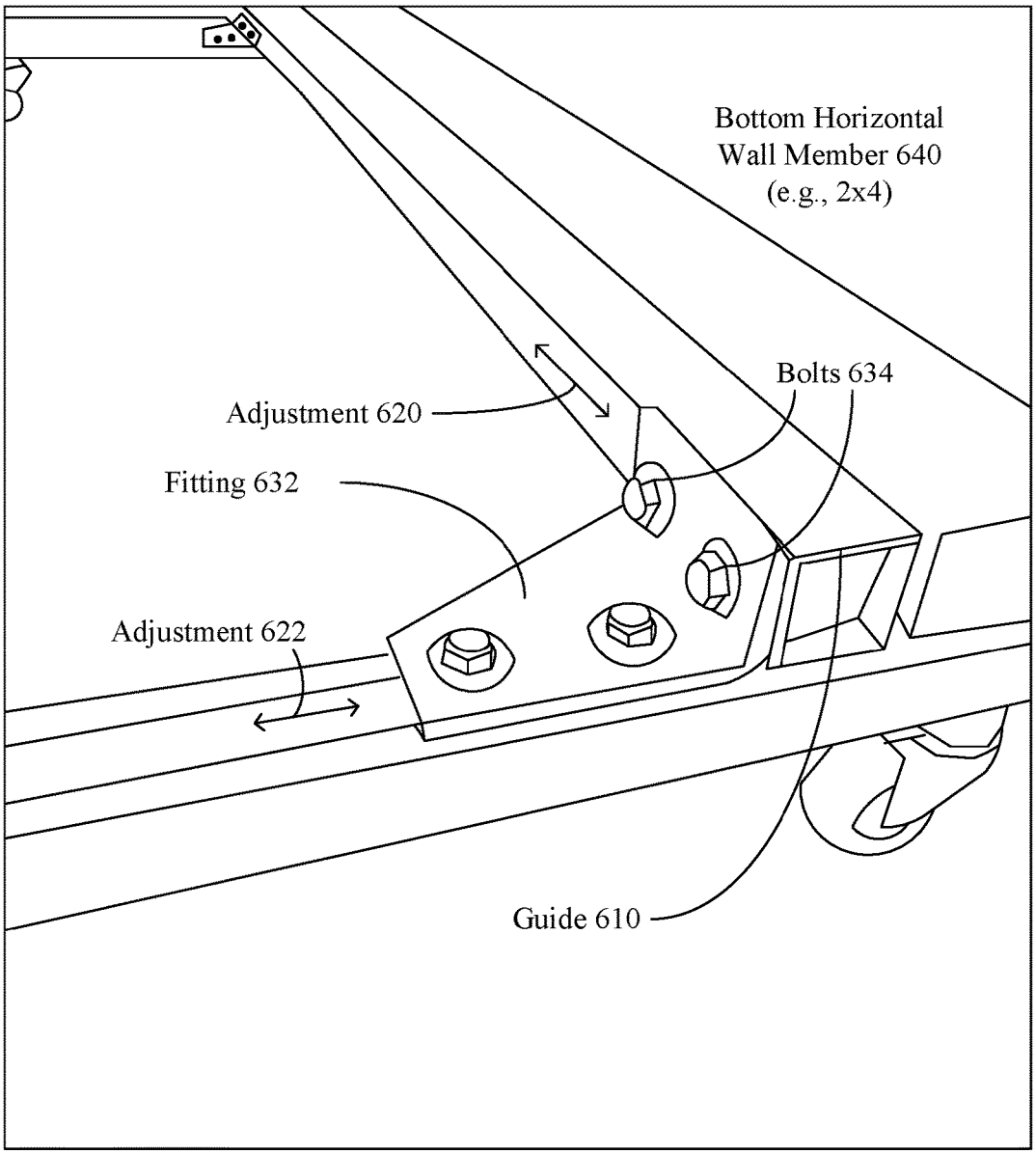
FIG. 6B illustrates a close view of a fitting for adjustment of the removable wall platform members.

In another embodiment (shown in FIG. 6A), the cross members are positioned below the caster arm, which thereafter functions as a guide 610 for a bottom horizontal wall member 640. The cross members are adjustable in position 622, such as by moving a securable fitting 632 along a channel. The arm is also adjustable (620), to accommodate different positions/sizes of a wall member (640). In one embodiment (not shown) a length of the arm is also adjustable (such as by having a circumference of one member fit without another (as shown for vertical member in FIG. 1K, for example). Adjustments of the arm can occur by having a retaining nut or screw 630 lock into pre-configured adjustment points as shown in FIG. 6A. In FIG. 6B, a channel exists along with bolts 634 associated with fitting 632, which are able to be tightened/loosened to slide the cross members up/down the length of the arm. The fittings and mechanisms shown for adjustments 620 and 622 are illustrative and other mechanisms known to produce equivalent advantages are contemplated.

It should be noted, that when the jig and wall platform are used for interior wall segment construction, after outer walls are created and placed on the slab, some height restrictions may be present. For example, if outer walls (exterior ones) are just over eight feet in height, the extra four inches on the bottom of the wall platform (from the wheels) may be problematic. In such as case, the platform can be adjusted (wheels removed) to ensure that the walls are constructed within a height restricted setting. In such as case, manual movement of the wall segments (for interior walls) may be the best option. The jib 126 assembly itself can be assembled/disassembled in place, which does not impose any transportation problems as individual components break down into relatively small elements able to be transported in/out of door openings. In one embodiment, a slight angle of 5 degrees, 10 degrees, 15 degrees, 20 degrees or 25 degrees (See FIGS. 2B and 1E) (angle depends on height restrictions) can be established for both the vertical support 122 and the movable platform to permit a moving platform (with a vertical wall/roofing member angled to reduce height to allow for vertical clearance) can be incorporated. This angle permits movement of interior wall within tight-spacing (ceiling), while still being able to take advantage of the mechanical advantages of rolling a completed segment into place to minimize construction worker strain. Thus, the angle see FIG. 5C of the platform and the vertical beams are able to be adjusted from a baseline horizontal plane in contemplated embodiments. Securing mechanisms (such as ropes, guides) are contemplated in embodiments where an angle is used as described herein to ensure the wall/ceiling segments under construction to not destructively shift as they are moved into place on site.

The flowchart and block diagrams in the FIGS. 1A-6B illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A system for a vertical wall construction, the system residing at a construction site and comprising:

an assembly jig and a removable wall platform, the assembly jig comprising:

at least two parallel vertical supports, two perpendicular horizontal supports, at least one bracket support and at least one assembly support beam cooperatively configured to support the at least two parallel vertical supports in a substantially vertical orientation, wherein each one of the vertical supports comprises a vertical adjustable height and at least one telescopic connection configured to reduce the vertical adjustable height, wherein the two perpendicular horizontal supports comprises at least a top horizontal support and a bottom horizontal support, the at least one bracket support connected to a corresponding parallel vertical support substantially around a distal end thereof, the at least one assembly support beam connected to the bracket support and to the corresponding parallel vertical support substantially around a proximal end thereof, wherein the removable wall platform is able to be removed after construction of a vertical assembled wall, and wherein the removable wall platform completely supports the vertical assembled wall and is able to transport the wall to a location different from the assembly jig without additional construction equipment, wherein the top and bottom horizontal support comprises spacers which temporarily brace the vertical assembled wall during vertical assembly thereof.

2. The system of claim 1, wherein the removable wall platform is a free moving element independent from the assembly jig, rotatable or movable in any horizontal direction parallel to a ground surface while supporting the vertical assembled wall.

* * * * *